US005088937A

United States Patent [19]

Gabany

[11] Patent Number: 5,088,937

[45] Date of Patent: Feb. 18, 1992

[54] RIGHT ANGLE COAXIAL JACK CONNECTOR

[75] Inventor: Andrew J. Gabany, Mechanicsburg, Pa.

[73] Assignee: AMP Incorporated, Harrisburg, Pa.

[21] Appl. No.: 687,820

[22] Filed: Apr. 19, 1991

[51] Int. Cl.[5] ..... H01R 13/00

[52] U.S. Cl. ..... 439/581

[58] Field of Search ..... 439/578-585

[56] References Cited

U.S. PATENT DOCUMENTS 3,047,828 7/1962 Gregson et al. ..... 439/582

3,179,912 4/1965 Huber et al. ..... 339/17

4,360,244 11/1982 Forney, Jr. et al. ..... 339/177 R 4,548,453 10/1985 Mummey et al. ..... 339/17 C 4,598,961 7/1986 Cohen ..... 439/581

4,741,703 5/1988 Johnescu et al. ..... 439/581

*Primary Examiner*—Joseph H. McGlynn

[57] ABSTRACT

A right angle coaxial connector jack (10) includes a metal shell (12) with integral metallic grounding pins (30) and a metallic cap (32), locking insulators (50, 58) within the shell carrying a signal contact (38). The shell (12) includes an aperture in the rear face facilitating a straight action assembly of elements to seal said connector against contamination and radiation.

8 Claims, 4 Drawing Sheets

RIGHT ANGLE COAXIAL JACK CONNECTOR

This invention relates to a right angle coaxial connector for interconnecting RF signals to a printed circuit board.

BACKGROUND OF THE INVENTION

U.S. Pat. No. 3,179,912 granted Apr. 20, 1965 is drawn to a coaxial connector for printed circuit boards adapted to receive a plug contact on the end of a coaxial cable and interconnect the signal and ground paths of the connector to the signal and ground paths of the printed circuit board. The patent features a coaxial jack which fits into a printed circuit board at right angles or other angles by virtue of legs connecting a shell containing an insulator and a contact pin. U.S. Pat. No. 4,360,244 granted Nov. 23, 1982 shows a miniature coaxial connector assembly including an outer metal shell containing an insulator housing a signal pin with grounding pins connected to such shell and the dimensions and dielectric relationships align for a substantial RF performance, a frequency of 2 GHz being mentioned. Both of the foregoing patents include structures which are open proximate the printed circuit board mounting. This opening is subject to contamination during solder and fluxing operations to join the connectors to a printed circuit board, the presence of which can alter the characteristic impedance by changing the effective dielectric of the connector's design. Moreover, should conductive debris lodge in the spaces, an actual short between signal and ground may occur. As a final point, the open ends of the connectors allow radiation outwardly of the connector from the RF energy being transmitted therethrough, or alternatively, radiation entering the connector to couple into the signal being transmitted thereby.

Accordingly, it is an object of the invention to provide a right angle coaxial connector of improved electrical characteristics at signal frequencies up to and exceeding 2 GHz. It is a further object to provide a connector which is sealed against contamination entering the connector and sealed against radiation entering or being emitted by such connector. It is still a further object to provide a right angle coaxial connector construction which facilitates a ready assembly of the major elements of the connector in insertion strokes which are on a single direction.

SUMMARY OF THE INVENTION

The present invention achieves the foregoing objectives and overcomes prior art limitations through the use of a die cast metal shell having integral pins extending at right angles therefrom. The pins both mount the connector firmly in a printed circuit board when soldered thereto and join the grounding path of a printed circuit board to the metal shell of the connector while at the same time providing a grounding that surrounds a signal path carried by a signal pin held within the shell by dielectric material. The dielectric material is formed of a sleeve which carries the forward end of the pin and a disc of dielectric material which carries the rear end of the pin with the ends of such sleeve and disc beveled in a way to rest against each other preventing displacement at least in one direction relative thereto. The shell of the invention includes a central bore which receives in a wedge fit the dielectric sleeve and a contact pin which may be preassembled and further includes in the rear a keyway allowing the insulating sleeve and pin to be inserted directly into the shell without being manipulated to both ease manual assembly or facilitate a simple automatic assembly. The keyway contained in the metal shell of the connector is filled with a cap which slides therein and is staked to such shell to be locked in place. The cap includes a projection which bears against the dielectric disc to hold such in position and the two elements, cap and disc, effectively seal the connector interiorly from contamination and entering or emitted radiation; the shell fitting against a printed circuit board where the ground plane thereof effectively shields the aperture through which the signal pin extends.

IN THE DRAWINGS

DETAILED DESCRIPTION OF THE INVENTION

Figure 1:
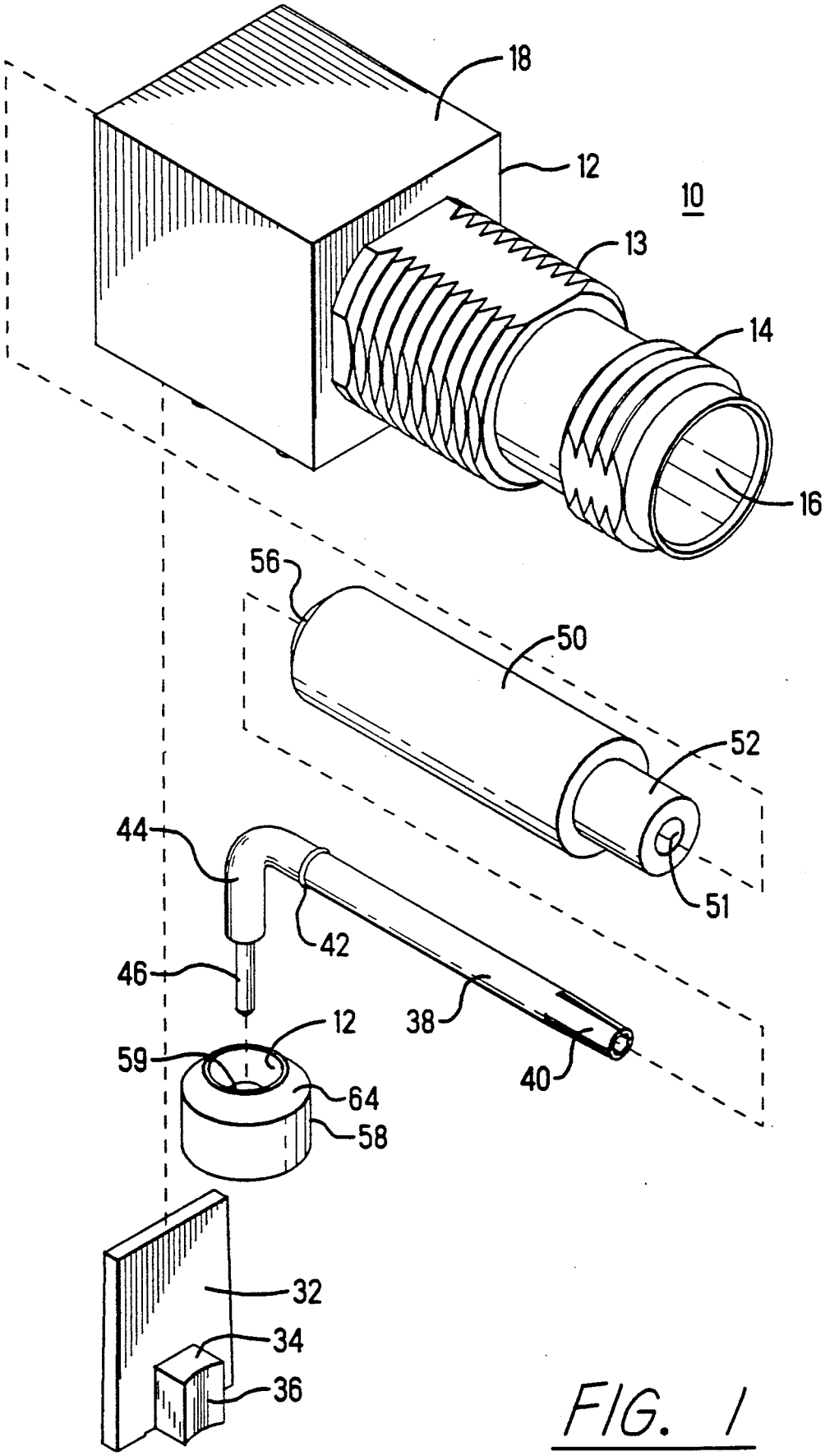
FIG. 1 is an exploded perspective showing the elements of the connector of the invention with the order of assembly shown by phantom lines.
Figure 2:
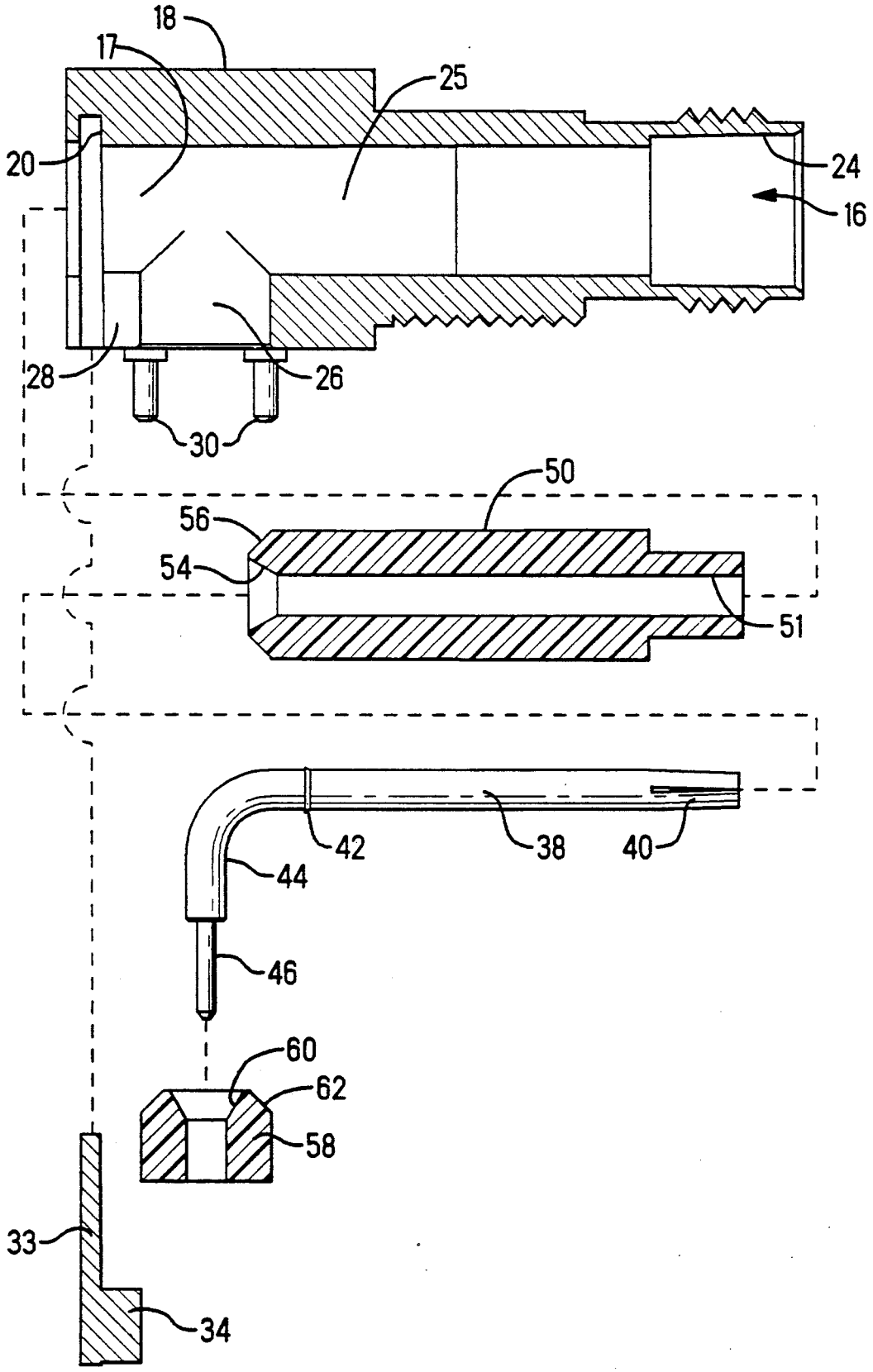
FIG. 2 is a side elevational view of the elements shown in FIG. 1, shown in partial section.
Figure 4:
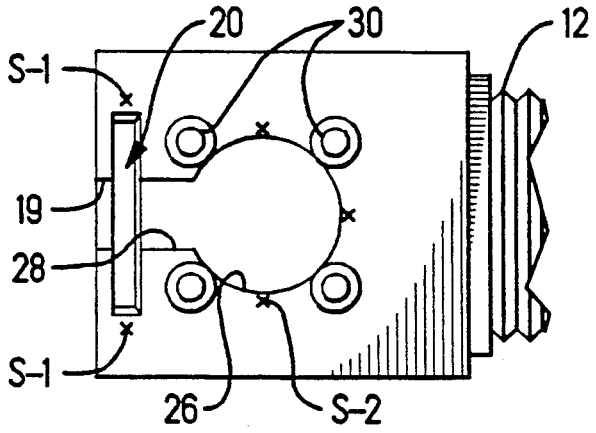
FIG. 4 is a view of the connector shell, the rear end thereof, viewed from the bottom and prior to assembly of elements therewithin.
Figure 5:
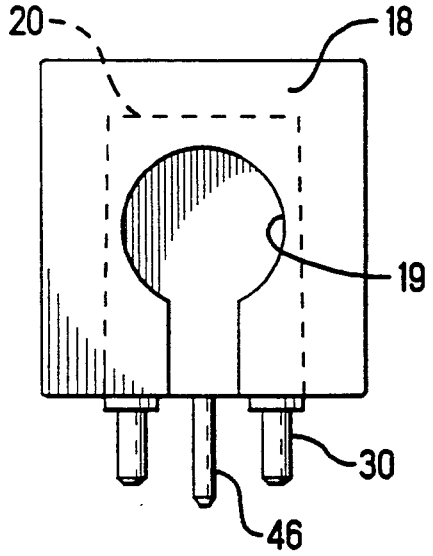
FIG. 5 is an elevation of the rear of the shell of the invention showing details in phantom of the cap slot.

Referring now to FIG. 1, the elements of the invention forming a right angle coaxial jack connector 10 are shown to include an outer metallic shell 12, a first insulating and dielectric sleeve 50, a signal contact pin 38, an insulating disc 58, and a metallic cap 32. The phantom lines show the order of assembly and orientation of such elements. FIG. 2 shows such elements as assembled. Reference may be had to the aforementioned patent '244 for a general teaching of a coaxial connector assembly showing ground and signal paths joined to traces on a printed circuit board. The present invention connector would be similarly mounted on a printed circuit board, typically at one edge thereof with portions projecting at right angles to the plane of the board to be fitted through a bezel or face plate to allow access to the coaxial path. Accordingly, the invention shell includes a first threaded portion 13 which would be extended through a bezel or face plate having a knockout aperture complementing the shape of the threaded portion which, as can be seen in FIG. 1, is flattened to cooperate with a knockout shape and provide orientation. A nut, not shown, would be threaded onto the threading 13 to lock the bezel or plate to the connector shell which is in turn fitted on and mechanically joined to a printed circuit board. The outer threading 14 on the shell 12 serves to receive a threaded nut as part of the mating plug connector half, the use of threading providing a better seal against radiation entering the connector 10 or escaping therefrom as well as a more secure mechanical joining of connector halves than the simple slide fit shown in the previously mentioned U.S. Patents. Shell 12 includes a central bore 16 which includes an enlarged forward portion 24 leading to a narrowed portion 25 and at right angles thereto, a short bore 26. As shown in FIGS. 4 and 5, there is a further aperture 19 which serves as a keyway to facilitate the insertion from the rear of the shell of a subassembly comprised of pin 38 preinserted into sleeve 50. FIG. 5 also shows in phantom the interior relief, slot 20 of a configuration to receive the outside edges of cap 32. Viewing the rear portion 18 of shell 12 in FIG. 4, a further aperture 26 is shown which has a diameter adapted to receive insulating disc 58 and a slot 28 adapted to receive the portion 34 of cap 32.

Figure 3:
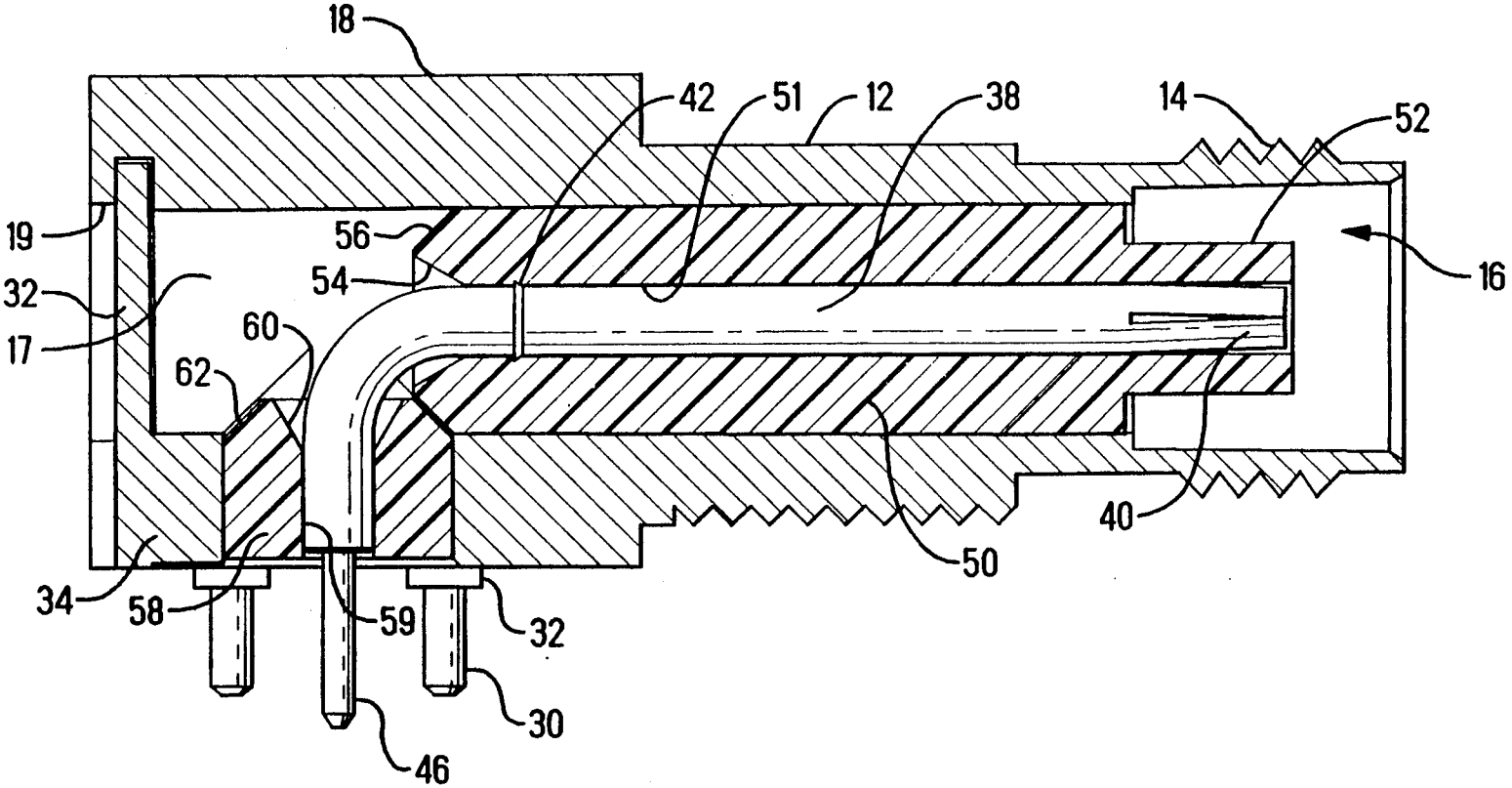
FIG. 3 is a side, elevational, and partially sectioned view of the elements shown in FIG. 2 as assembled.

Extending from the underside of shell 12 in the manner shown in FIGS. 2–4 are ground pins 30 which each include a standoff 32. These pins are mechanically integral with shell 12 and preferably formed therewith as by diecasting of zinc material suitably plated with copper and thereafter with nickel or other finishes. As can be seen in FIG. 4, there are preferably four ground pins spaced equidistant to the signal pin 38, the rear projecting portion 44 thereof, as indicated in FIGS. 3 and 5. Having the grounding pins 30 in essence surrounding the signal path provides a shielding effect and grounding relationship that is coaxial as well as providing a secure mechanical mounting through the insertion of such pins in holes in a printed circuit board containing eyelets or the equivalent soldered to join the pins electrically and hold them mechanically.

The cap 32, as shown in FIGS. 1 and 2, has an exterior configuration to fit into the rear of shell 12, the slot 20, as shown in FIG. 5, and seal the rear face against radiation emitted from the coaxial transmission taking place within the connector and from entering the connector exterior therefrom. The cap 32 is of a metallic construction, preferably diecast to include a central projection 34 in the manner shown in FIG. 1 which may further include a series of fine serrations 36 which grip the dielectric disc 58 upon assembly.

The signal contact pin 38 includes details as shown in FIGS. 1 and 2, including a forward spring portion 40 formed by a bore suitably slotted and adapted to receive the pin portion from a mating connector inserted therewithin during mating of connector halves, plug and jack. Pin 38 further includes a barb 42 oriented as indicated in FIG. 2 and in FIG. 3 that bites into the material of sleeve 50 to lock the pin 38 to such sleeve. Pin 38 includes a right angle portion 44 and a projecting pin portion 46 extended through a printed circuit board and soldered to a signal trace thereon or therein.

Sleeve 50, preferably molded of Teflon to provide a relatively low dielectric constant, includes a forward reduced diameter portion 52 that fits within the end of a mating plug used with jack 10 and at the opposite end, a double beveled portion, including a bevel 54 interiorly oriented and a bevel 56 exteriorly positioned. The bevel 54 facilitates assembly of pin 38 fitted within a bore of sleeve 50 and the exterior bevel facilitates a mating with a beveled surface 62 on disc 58. The disc 58, as shown in FIGS. 1–3, further includes an interior bevel 60 to facilitate assembly onto pin 38, right angle portion 44. Bevel surface 56 and the bevel 62 fit together in the manner as shown in FIG. 3 to limit the inward displacement of sleeve 50 which is provided with a diameter relative to the shell, bore 25 to provide a wedge fit against displacement. These engaging beveled surfaces 56 and 62 similarly prevent the inward displacement of the disc 58. The exterior diameter of 58 fits within the bore 26 of shell 18 in the manner shown in FIG. 3.

The connector elements are assembled by first inserting pin 38 within sleeve 50 to a point wherein the end 40 of the pin is proximate the end of reduced portion 52 of the insulating sleeve. At that point, barb 42, through biting into the material of the sleeve, effectively locks the two elements together. Thereafter, the subassembly of pin 38 and sleeve 50 is inserted axially through aperture 19, note FIG. 5, until it is seated within the bore 25 of shell 12 in the manner shown in FIG. 3. To be appreciated is that the insertion of the subassembly of pin and sleeve is in a straight axis along the axis of the bore 25 with no need to manipulate the subassembly, cocking it and maneuvering it around protrusions as in the manner of the Patent '244 heretofore mentioned. This facilitates assembly by hand and more particularly, by a simple assembly insertion as through a robot with the shell 12 being held and the subassembly being directly inserted. Following the insertion of the subassembly, disc 58 may be added by being slipped over the end 44 of pin 38, the side walls of bore 26 receiving such disc and the beveled portion 62 limiting insertion of the disc by an engagement with beveled portion 56 of sleeve 50. Thereafter, the cap 32 may be inserted in slot 20 until it is seated in the manner shown in FIG. 3. Following that operation, a series of stakes shown as SI to lock cap 32 within the shell and S2 to lock the disc within the shell are made to displace material slightly interfering with the cap and disc respectively. These staking indentations should be limited to preclude a fracture of the zinc material of which the shell is made or the plating thereon. Once the parts are assembled in the manner described and suitably staked, the jack connector elements will remain properly positioned and assembled through handling and use through installation on a printed circuit board.

Having now described the invention in terms intended to enable a preferred practice thereof, claims are set forth intended to define the invention.

I claim:

1. A right angle coaxial jack connector for intermating ground and signal paths of a coaxial plug connector to a printed circuit board including a metallic shell having a plurality of metallic grounding pins protruding from the shell bottom surface adapted to fit within holes of printed circuit board to electrically ground said shell to the ground circuit of said board and to mechanically hold said jack to said board through being soldered thereto, said shell further including a central bore leading to a rear face, an insulating sleeve fitted in said bore including a sleeve bore coaxially positioning a connector signal contact within said shell, a keyway in the said rear face of said shell adapted to receive the insulating sleeve carrying the said signal contact inserted along the shell bore axis into position within said shell, the said signal contact having a forward end adapted to mate with a coaxial plug connector and a rear end at right angles to the axis of the said shell bore adapted to extend into a printed circuit board to be connected to a signal trace thereof, the said rear end of said signal contact extending between the said ground pins, an insulating disc surrounding the rear end of said signal contact to hold said contact coaxially positioned within said shell, a metallic cap fitted into the rear face of said shell to close off the said keyway and seal the said shell in conjunction with the said insulating sleeve and disc against entry of contamination within the said shell and reduce radiation emitted from the said plug connector or transmitted from the exterior of said shell to provide improved RF characteristics.

2. The jack connector of claim 1 further including means engaging said cap and said disc to preclude displacement thereof relative to said shell.

3. The plug connector of claim 1 wherein the said shell includes four ground pins spaced equidistant from the said signal contact pin as extended therebetween.

4. The plug connector of claim 1 wherein the said disc and insulating sleeve include beveled end portions adapted to engage to lock the said disc and sleeves together against displacement toward each other.

5. The plug connector of claim 1 wherein the said shell and pins are formed of an integral casting.

6. The plug connector of claim 1 wherein the said cap and disc cooperate to seal the interior of said shell against the entry of contaminants.

7. The plug connector of claim 1 wherein the said shell includes a slot in the rear face thereof and the said cap includes an edge tightly fitting within said slot to seal the said keyway against radiation.

8. The plug connector of claim 1 wherein the said shell and cap are formed of diecast zinc material having a suitable plating finish thereon.

* * * * *